US009574295B2

(12) United States Patent
Kim et al.

(10) Patent No.: US 9,574,295 B2
(45) Date of Patent: Feb. 21, 2017

(54) WASHING MACHINE AND METHOD OF CONTROLLING SAME

(71) Applicant: LG ELECTRONICS INC., Seoul (KR)

(72) Inventors: Sunmi Kim, Seoul (KR); Dowan Kim, Seoul (KR); Youngkee Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 326 days.

(21) Appl. No.: 14/169,615

(22) Filed: Jan. 31, 2014

(65) Prior Publication Data

US 2014/0208523 A1 Jul. 31, 2014

(30) Foreign Application Priority Data

Jan. 31, 2013 (KR) ..... 10-2013-0011195

(51) Int. Cl.
*D06F 35/00* (2006.01)
*D06F 39/00* (2006.01)
(Continued)

(52) U.S. Cl.
CPC ..... *D06F 35/006* (2013.01); *D06F 39/003* (2013.01); *D06F 39/008* (2013.01);
(Continued)

(58) Field of Classification Search
CPC .... D06F 35/006; D06F 39/003; D06F 39/008; D06F 39/04; D06F 39/087; D06F 2202/10; D06F 2204/04; D06F 2204/08
See application file for complete search history.

(56) References Cited

U.S. PATENT DOCUMENTS 7,287,292 B2 10/2007 Kim
7,600,402 B2 * 10/2009 Shin ..... D06F 25/00 68/5 C
(Continued)

FOREIGN PATENT DOCUMENTS

CA 2 654 472 A1 3/2008
CN 1989288 A 6/2007
(Continued)

OTHER PUBLICATIONS

Australian Office Action issued in Application No. 2014200548 dated Apr. 15, 2015.

*Primary Examiner* — Joseph L Perrin
(74) *Attorney, Agent, or Firm* — KED & Associates, LLP

(57) ABSTRACT

Disclosed are a washing machine that performs a washing course by heating wash water and a control method thereof. The method may include selecting a certain washing course from a plurality of washing courses, sensing an amount of laundry received in an inner tub and determining a wash water level required for main washing of the determined amount of laundry, supplying wash water up to a wash water level for generation of steam such that a portion of the laundry is moistened, the wash water level being higher than a bottom surface of the inner tub and lower than the wash water level for main washing, heating the wash water to a first set temperature and driving a wash water heater to generate steam from the wash water, supplying additional wash water up to the wash water level for main washing, and performing a main washing cycle.

17 Claims, 7 Drawing Sheets

(51) Int. Cl.
*D06F 39/04* (2006.01)
*D06F 39/08* (2006.01)

(52) U.S. Cl.
CPC ..... *D06F 39/04* (2013.01); *D06F 39/087* (2013.01); *D06F 2202/10* (2013.01); *D06F 2204/04* (2013.01); *D06F 2204/08* (2013.01)

(56) References Cited

U.S. PATENT DOCUMENTS

| | | | | |
|---|---|---|---|---|
| 8,181,299 | B2 * | 5/2012 | Cho | D06F 35/006 8/159 |
| 2004/0163183 | A1 * | 8/2004 | Kim | D06F 33/02 8/137 |
| 2005/0092035 | A1 | 5/2005 | Shin et al. | |
| 2006/0101586 | A1 | 5/2006 | Park et al. | |
| 2008/0134445 | A1 * | 6/2008 | Cho | D06F 35/006 8/149.1 |
| 2009/0013729 | A1 | 1/2009 | Park | |
| 2009/0272155 | A1 * | 11/2009 | Jeong | D06F 35/006 68/5 C |
| 2010/0083445 | A1 | 4/2010 | Kim et al. | |
| 2011/0126360 | A1 | 6/2011 | Cho et al. | |
| 2011/0138542 | A1 | 6/2011 | Ji et al. | |

FOREIGN PATENT DOCUMENTS

| | | | |
|---|---|---|---|
| CN | 101781839 | A | 7/2010 |
| JP | 04-158896 | | 6/1992 |
| JP | 2000-0014982 | A | 1/2000 |
| JP | 2005-193003 | A | 7/2005 |
| JP | 2008-532686 | A | 8/2008 |
| JP | 2010-502357 | A | 1/2010 |
| JP | 2011-104150 | A | 6/2011 |
| JP | 2012-005876 | A | 1/2012 |
| JP | 2012-161621 | A | 8/2012 |
| KR | 10-2005-0062846 | A | 6/2005 |
| KR | 10-0698147 | | 8/2006 |
| KR | 10-0739609 | B1 | 7/2007 |
| KR | 10-2009-0105120 | A | 10/2009 |
| KR | 10-2009-0124564 | A | 12/2009 |
| KR | 10-2011-0063059 | A | 6/2011 |

* cited by examiner

WASHING MACHINE AND METHOD OF CONTROLLING SAME

CROSS-REFERENCE TO RELATED APPLICATION(S)

This application claims priority under 35 U.S.C. §119 to Korean Application No. 10-2013-0011195 filed in Korea on Jan. 31, 2013, whose entire disclosure is hereby incorporated by reference.

BACKGROUND

1. Field

This relates to a washing machine and, more particularly, to a washing machine capable of performing a washing course by heating wash water, and a method of controlling the same.

2. Background

A washing machine may remove contaminants from laundry using wash water and a detergent, in particular, by making use of a chemical action achieved through a detergent dissolved in wash water. Contaminants may also be removed through mechanical action of the wash water or mechanical action generated by the driving of an inner tub or a drum.

BRIEF DESCRIPTION OF THE DRAWINGS

The embodiments will be described in detail with reference to the following drawings in which like reference numerals refer to like elements wherein.

DETAILED DESCRIPTION

Figure 1:
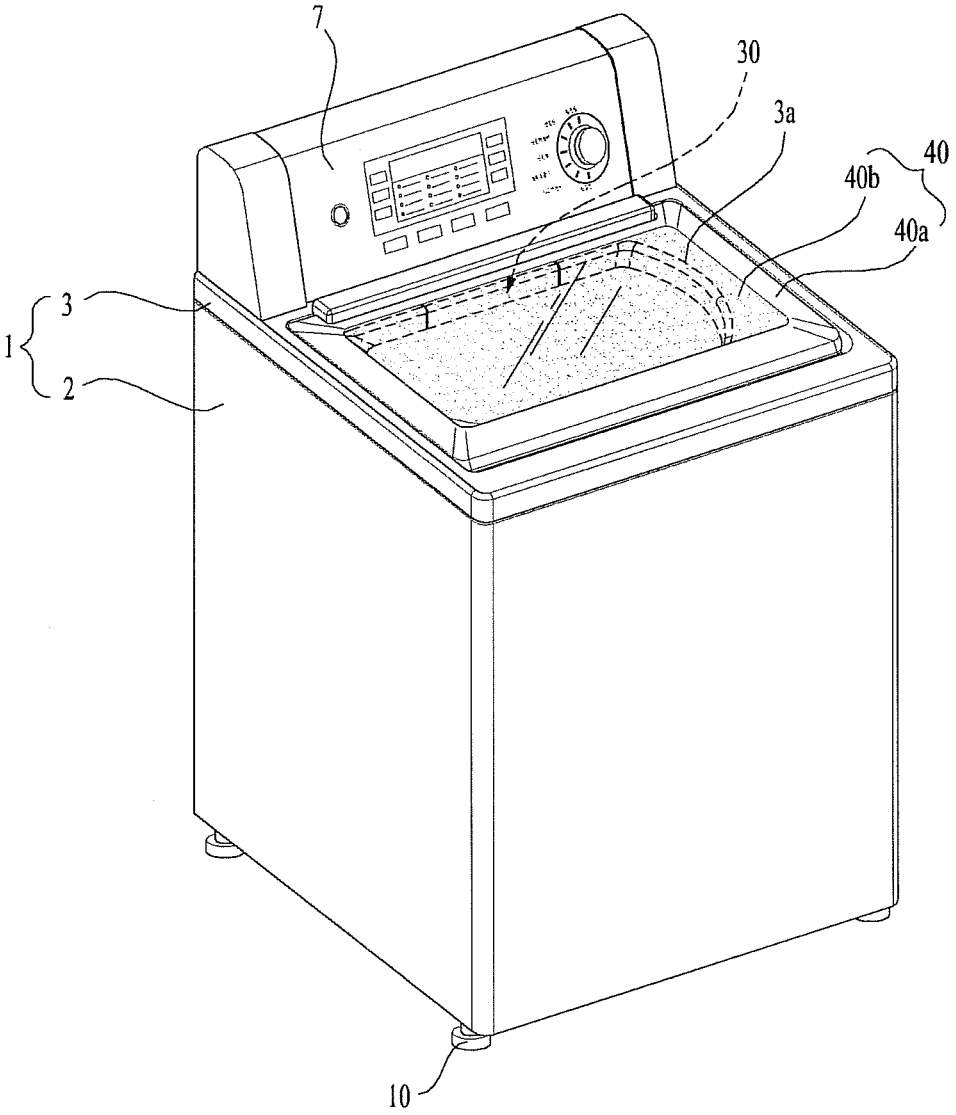
FIG. 1 is a perspective view of a washing machine according to one embodiment as broadly described herein.

Reference will now be made in detail to various embodiments, examples of which are illustrated in the accompanying drawings. Wherever possible, the same reference numbers will be used throughout the drawings to refer to the same or like parts.

Certain washing machines may include a washing heater capable of heating wash water to promote activation of the detergent and boost the effect of sterilization of the laundry through heat. Certain washing machines capable of supplying steam to create a high temperature washing environment and reduce energy consumption. Steam may be produced by heating water to a temperature higher than the boiling point thereof. In this case, invisible steam may be produced.

Steam may also be produced by heating water to a temperature lower than the boiling point thereof. In this case, visible steam may be produced.

Washing machines may include a horizontal shaft washing machine and a vertical shaft washing machine. A horizontal shaft washing machine performs washing by driving an inner tub (a drum) about a horizontal shaft to remove contaminants by applying mechanical energy to the laundry through driving of the drum. In the horizontal shaft washing machine, the laundry is not fully submerged in wash water. Accordingly, most of the mechanical action may be derived from friction between laundry items, friction between the laundry and the drum, and shock applied to the laundry. In this case, washing may also be implemented through chemical action of the detergent.

A vertical shaft washing machine performs washing through rotation of an inner tub (a drum) about a vertical shaft or rotation of a pulsator in the inner tub to remove contaminants by applying mechanical energy to the laundry through driving of the inner tub or the pulsator. In the vertical shaft washing machine, the laundry may be fully submerged in wash water, so that a large portion of the mechanical action for washing may be derived from friction between water current and the laundry or shock. In this case, washing may also be implemented through chemical action of the detergent.

As such, the vertical shaft washing machine differs from the horizontal washing machine in the amount of wash water used in washing and washing mechanism. Despite this difference, both the horizontal shaft washing machine and the vertical shaft washing machine may include a washing heater to heat wash water to increase the temperature of wash water to a predetermined temperature. However, heating a large amount of wash water to a predetermined temperature may not be energy efficient. Accordingly, the start time of heating of wash water, the amount of wash water at the start time of heating, the number of times heating is performed, and the heating temperature may be optimized for a particular washing course to achieve a desired washing effect and reduce energy consumption.

Certain washing machines may have a cycle in which a small amount of water is supplied prior to a washing cycle so that a steam generating cycle may be performed before a main washing cycle. However, these types of washing machines only sterilize dry laundry using steam, providing any washing effect and/or removal of surface contaminants, because enhancement of the washing effect cannot be achieved simply by sterilization through increase in water temperature.

It may be beneficial to people suffering from allergies caused by insects, for example, dust mites, and in particular, infants, who are very vulnerable to dust mites, to have a way to effectively destroy the mites from items being laundered. However, unlike general mold and germs, mites are not easily removed simply by creating a high temperature environment.

Figure 2:
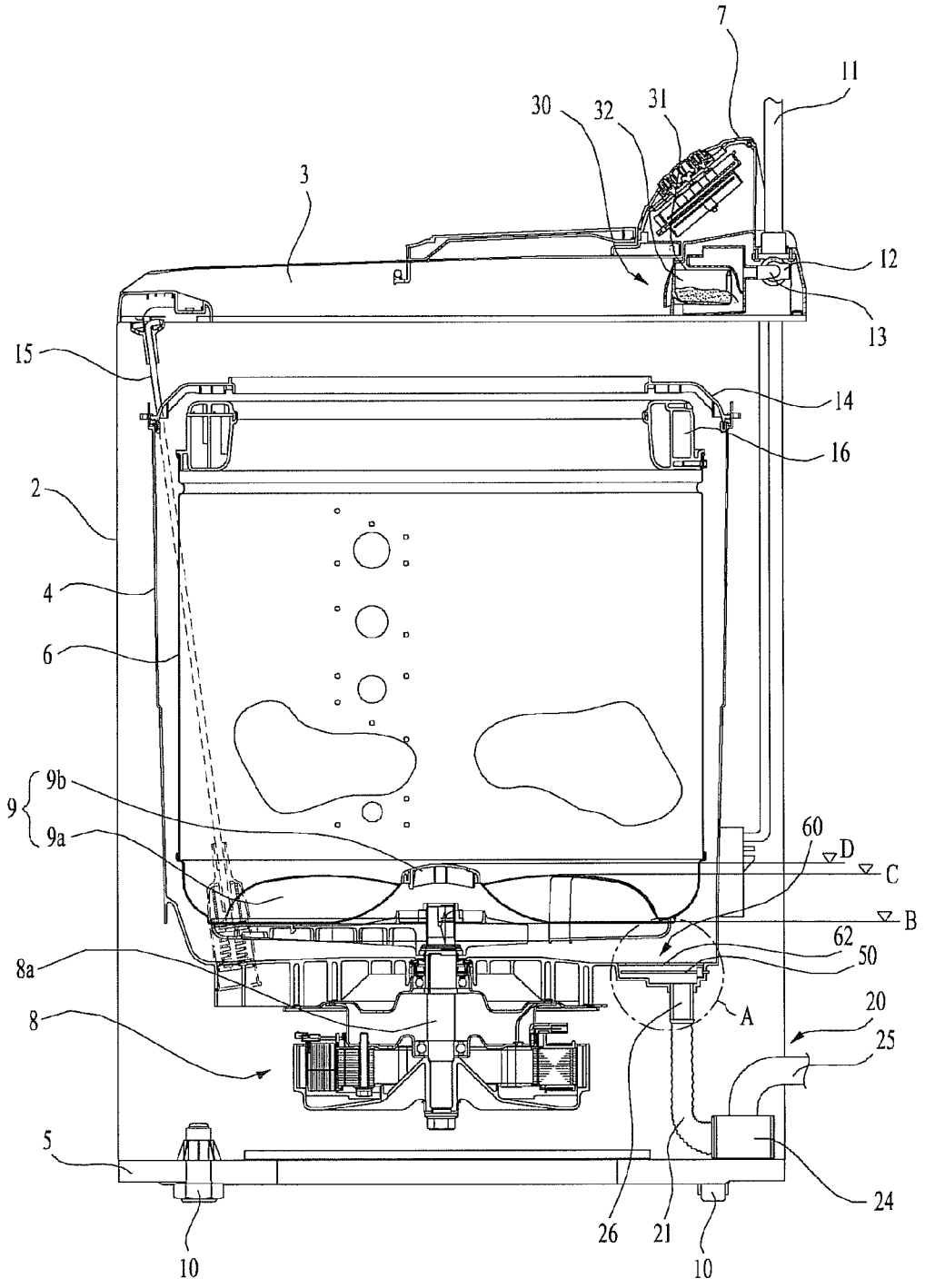
FIG. 2 is a cross-sectional view of the washing machine shown in FIG. 1.
Figure 3:
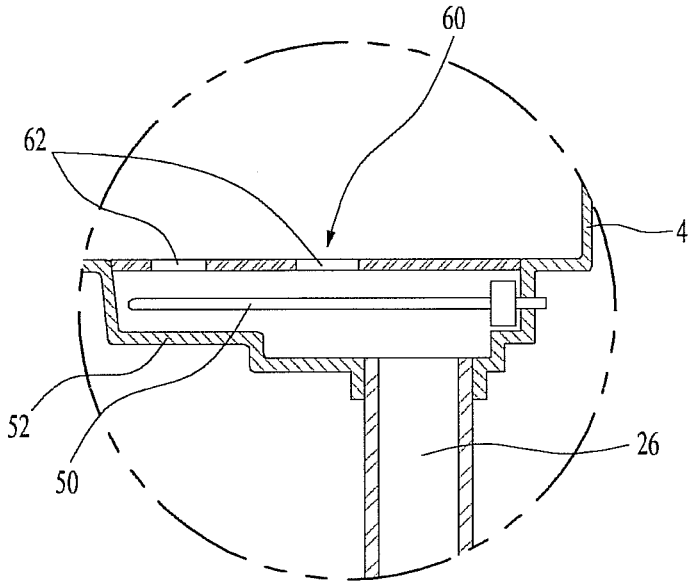
FIG. 3 is an enlarged view of a portion A shown in FIG. 2.

A washing machine applicable to an embodiment will be described in detail with reference to FIGS. 1 to 3. The exemplary washing machine shown in FIGS. 1-3 is a vertical shaft washing machine. However, a washing machine and a method of controlling the same according to this embodiment are not limited to the vertical shaft washing machine, and may also apply to other types of washing machines.

Referring to FIGS. 1 and 2, a washing machine as embodied and broadly described herein may include a case 1 forming the external appearance thereof, and a leg assembly 10 coupled to the lower portion of the case 1. The case 1 may include a side cabinet 2 having open upper and lower surfaces and forming the lateral surface of the washing machine, a top cover 3 installed to cover the open upper surface of the side cabinet 2, and a base 5 installed at the open lower surface of the cabinet 2.

Disposed in the cabinet 2 are an outer tub 4 to accommodate wash water, an inner tub 6, or drum 6, disposed inside the outer tub 4 to accommodate laundry, a driver including a motor to drive the inner tub 6 and a shaft 8*a* to transfer the driving force of the motor 8 to the inner tub 6, a water supply device 30 to supply water into the outer tub 4, and a drainage assembly 20 to drain water from the outer tub 4 after washing or dehydrating is completed.

The water supply device 30 includes a detergent box 32 installed at the top cover 3 to temporarily store detergent. The detergent box 32 may be accommodated in a detergent box housing 31. The detergent box 32 may be mounted to and detached from the detergent box housing 31 in a slideable manner, as a drawer.

The water supply device 30 may include a water supply valve 12 and a water hose 13. The water supply valve 12 may be connected to an external hose 11. Thereby, wash water may be supplied from an external water supply source through the external hose 11. For example, the wash water supplied from the external water supply source may be fresh water.

For example, the water hose 13 may be connected to an external water supply source capable of supplying hot water and cold water. That is, a hot water hose and a cold water hose may be separately provided. In this case, the water supply valve 12 may include a hot water supply valve and a cold water supply value which are individually provided. Accordingly, when the water supply valve 12 opens, hot water and cold water may be individually or simultaneously supplied to the detergent box 32. In addition, the supplied wash water and the detergent may be supplied to the inner tub 6 together.

The detergent box 32 may be positioned to correspond to an open upper portion of the inner tub 6. In addition, wash water may be supplied such that the wash water falls toward the bottom surface of the inner tub 6. Accordingly, when the wash water is supplied, the laundry accommodated in the inner tub 6 becomes wet to some extent by the falling wash water, and the wash water containing the detergent wets the laundry.

The top cover 3 may include a laundry entrance hole 3*a* allowing laundry to be introduced or withdrawn therethrough. A door 40 to open and close the laundry entrance hole 3*a* is installed at the top cover 3. At least one portion of the door 40 may be formed of glass such that the interior of the inner tub 6 is visible. That is, the door 40 includes a frame 40*a* and a glass panel 40*b* fitted to the frame 40*a*. A control panel 7 to receive input regarding operation of the washing machine or display an operational state of the washing machine is mounted at one side of the top cover 3. That is, a user interface may be provided.

The outer tub 4 may be suspended by a plurality of suspensions 15 arranged at the inner upper portion of the cabinet 2. One end of each of suspension 15 is coupled to the inner upper portion of the cabinet 2, and the other end thereof is coupled to the lower portion of the outer tub 4.

A pulsator 9 to create rotary water current of the water received in the outer tub 4 is installed on the bottom surface of the inner tub 6. The pulsator 9 may be integrated with the inner tub 6 such that the inner tub 6 and the pulsator 9 rotate together when the motor 8 rotates. Alternatively, the pulsator 9 may be arranged separately from the inner tub 6 to rotate separately from the inner tub 6 when the motor 8 rotates. That is, only the pulsator 9 may rotate, or the pulsator 9 and the inner tub 6 may simultaneously rotate.

Installed at the upper end of the inner tub 6 is a balancer 16 to prevent the inner tub 6 from being unbalanced by maldistribution of the laundry. For example, a liquid balancer filled with a liquid such as salt water may be used as the balancer 16. An outer tub cover 14 is installed at the upper end of the outer tub 4 to keep the laundry in the inner tub 6 and prevent scattering of water.

Referring to FIG. 2, the drainage assembly 20 includes a first drainage hose 21 connected to a drainage hole 26 formed in the lower surface of the outer tub 4, a drainage pump housing 24 housing a drainage pump to pump water, and a second drainage hose 25 connected to the drainage pump housing 24 to discharge the water pumped by the drainage pump from the cabinet 2. A drainage motor to drive the drainage pump is arranged in the drainage pump housing 24. The drainage assembly 20 may be disposed between the outer tub 4 and the base 5.

FIG. 3 is an enlarged view illustrating portion A shown in FIG. 2. Referring to FIG. 3, a washing heater 50 to heat the wash water and a heater cover 60 to cover the upper side of the heater 50 may be mounted to a lower portion of the outer tub 4.

Specifically, a concave heater mounting groove 52 is formed at a lower portion of the outer tub 4 to allow the washing heater 50 to be disposed therein. The heater mounting groove 52 is located at the lowest portion of the outer tub 4. Accordingly, the wash water supplied through the inner tub 6 is introduced into the heater mounting groove 52 through the through hole formed in the inner tub 6. This is because the through hole is formed not only in the outer circumferential surface of the inner tub 6 but also in the bottom surface of the inner tub 6.

Due to the positions and structures of the outer tub 4, the inner tub 6 and the heater mounting groove 52, the wash water supplied to the inner tub 6 first fills the heater mounting groove 52 and then the level of wash water in the inner tub 6 gradually increases.

The drainage hole 26 is formed at one side of a lower portion of the heater mounting groove 52, and the washing heater 50 is disposed above the drainage hole 26.

The heater cover 60 may have a plate shape and may be formed of a metallic material with thermal resistance to withstand heat produced by the washing heater 50. The heater cover 60 may cover the heater mounting groove 52 and may be disposed on the same level with the lower surface of the outer tub 4. In addition, to allow the washing heater 50 to be seated on the lower surface of the outer tub 4, the heater mounting groove 52 may be formed such that the lower surface of the outer tub 4 has a stepwise shape. The heater mounting groove 52 may ensure that the washing heater 50 may be submerged with a minimum of wash water.

In the case that the lower surface of the outer tub 4 is stepped, alpha water current may not be consistently and efficiently produced. Herein, the alpha water current may refer to water current that is supplied to the upper portion of the inner tub 6 through rise of the wash water in the space between the inner tub 6 and the outer tub 4 according to rotation of the inner tub 6 at a high rate of rotation. Due to the heater mounting groove 52, the depth of water stored in the outer tub 4 may vary, which may impact the formation of alpha water current. For this reason, the heater cover 60 may cover the open upper end of the heater mounting groove 52. Due to the heater cover 60, the lower surface of the outer tub 4 may be substantially flat. In other words, stepping of the lower surface of the outer tub 4 may be addressed by the heater cover 60. As the stepping of the lower surface of the outer tub 4 is addressed by the heater cover 60, the alpha water current may be smoothly formed, increasing washing performance.

The heater cover 60 may be fastened and fixed to the lower surface of the outer tub 4 by a fastener. The heater cover 60 may be provided with a plurality of fastening holes and fastened by fasteners such as bolts or other fasteners as appropriate.

The heater 50 may be formed in a shape of a cylindrical bar or a bar with multiple curves and horizontally disposed.

The heater cover 60 is provided with one or more heater cover holes 62 to dissipate heat produced by the washing heater 50 and allow wash water to be supplied therethrough. At least one heater cover hole 62 may be formed. In this embodiment, two heater cover holes are assumed to be formed. The two heater cover hole 62 may have different shapes. Herein, the heater cover holes 62 will be assumed to be formed in an elliptical shape and a circular shape. The heater cover holes 62 may be formed to be larger than the drainage hole 26. The heater cover holes 62 may be formed at positions where they do not overlap the drainage hole 26.

When the upper end of the drainage hole 26 is open, air may be introduced through the upper end of the drainage hole 26 at the initial stage of drainage and, accordingly, abnormal noise may be produced due to an air layer through which water does not flow. Accordingly, the heater cover 60 is may be arranged to cover the entirety of the upper portion of the drainage hole 26, and the heater cover holes do not overlap the drainage hole 26 such that the heater cover holes 62 do not communicate with the drainage hole 26. That is, the circumference of each of the heater cover holes 62 is positioned spaced a predetermined distance from the circumference of the drainage hole 26 in vertical and horizontal directions.

Once draining starts with operation of the drainage pump, the wash water in the outer tub 4 is pumped out by the drainage pump. The pumped wash water sequentially passes through the drainage hole 26, the first drainage hose 21, the drainage pump, and the second drainage hose 25, and is then discharged outside.

At this time, the wash water in the outer tub 4 may be introduced into the drainage hole 26 through the heater cover holes 62 or the heater mounting groove 52.

In addition, since the heater cover 60 covers the upper end of the drainage hole 26, the upper portion of the drainage hole 26 may be ensured to be filled with wash water. Accordingly, air is prevented from flowing through the upper portion of the drainage hole 26 at the initial stage of draining or in the case that the flow rate for draining is low. Since air is not introduced into the upper portion of the drainage hole 26, generation of noise due to an air layer may be prevented, which may contribute to silent operation of the washing machine. In addition, prevention of introduction of air may also enhance the pumping performance.

Figure 4:
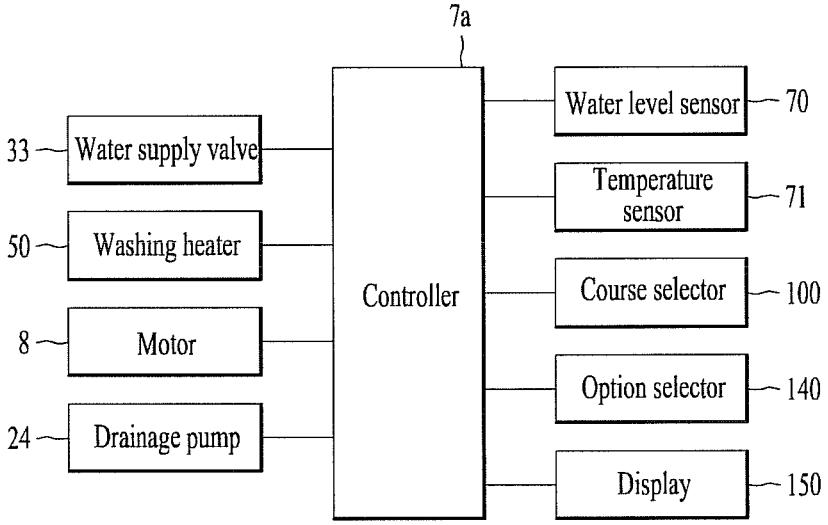
FIG. 4 is a block diagram of a washing machine according to one embodiment as broadly described herein.

FIG. 4 is a block diagram of a washing machine according to one embodiment as broadly described herein.

Operation of the washing machine is controlled by a controller 7*a*. The controller 7*a* may be arranged inside the control panel 7 shown in FIG. 1. The controller 7*a* may control operation of the washing machine based on signals input through a course selector 100 and an option selector 140 provided at the control panel 7. That is, the washing machine operates according to an operation course selected through the course selector 100 and an option selected through the option selector 140. Information about the selected operation course and option, time, and current status may be displayed on a display 150 according to control by the controller 7*a*.

The controller 7*a* may control operation of a water supply valve 33. By controlling the water supply valve 33, the amount of supplied wash water may be regulated. In addition, since the water supply valve 33 may include a hot water supply valve and a cold water supply valve, the temperature of the supplied wash water may be controlled by controlling the water supply valve 33.

The controller 7*a* may control operation of the washing heater 50. Accordingly, overheating of the washing heater 50 may be prevented, and the washing heater 50 may be operated until the wash water reaches a desired temperature.

The controller 7*a* may control operation of the motor 8. Accordingly, through control of the motor 8, the start time of driving of the motor and the driving pattern of the motor (e.g., rotation of the inner tub 6, rotation of the pulsator 9, rotation of the inner tub 6 for dehydrating operation) may be properly controlled.

The controller 7*a* may control operation of the drainage pump 24. Accordingly, drainage may be performed as needed.

The controller 7*a* may be connected to a water level sensor 70 and a temperature sensor 71. Accordingly, desired information related to the water level and the temperature may be supplied to the controller 7*a* by the sensors 70 and 71 at a specific time. The controller 7*a* may control operation of the water supply valve 33 based on the water level information supplied from the water level sensor 70. Accordingly, it is possible to supply wash water to a target water level. The controller 7*a* may control operation of the water supply valve 33 based on the temperature information supplied from the temperature sensor 71. Accordingly, wash water may be supplied at a target temperature. In addition, the controller 7*a* may control operation of the washing heater 50 based on the temperature information supplied form the temperature sensor 71, so that the wash water may be heated to the target temperature.

Figure 5:
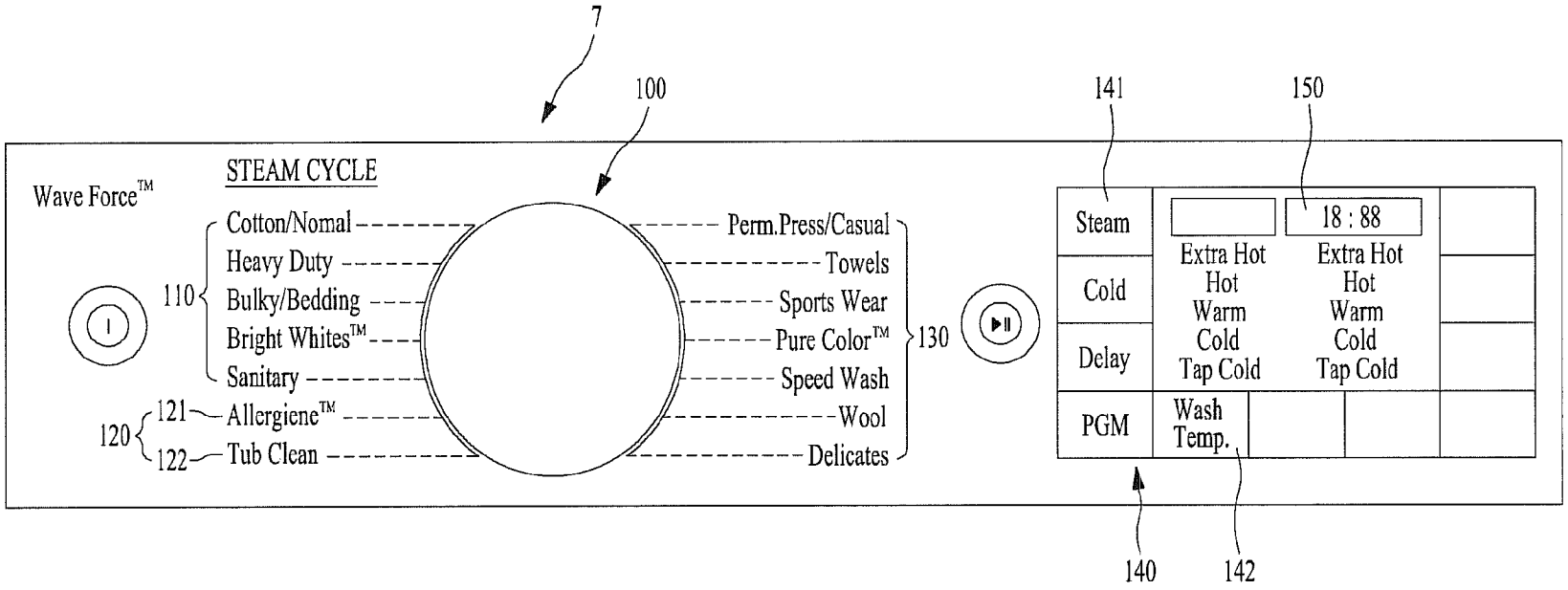
FIG. 5 is a front view of an exemplary control panel of a washing machine according to one embodiment as broadly described herein.

FIG. 5 is a front view of an exemplary control panel 7 of the washing machine according to this embodiment.

For the washing machine to wash various kinds of laundry, multiple washing courses may be selected and performed. In addition, the multiple washing courses may be selected and performed not only to perform washing but also to provide functionality. Accordingly, a user may easily select a desired washing course from a plurality of washing courses.

According to this embodiment, the washing machine may include the washing heater 50 to heat wash water. Additionally, steam may be generated by the washing heater 50 and supplied to the inner tub 6. Generation of steam by the washing heater 50 may suggest additional consumption of energy. Accordingly, the washing machine may be configured to provide clear indication to the user as to whether steam is in use. To this end, various operational courses may be provided with regard to steam.

The course selector 100 may provide for selection of a specific course from a plurality of courses. The courses may include steam-available courses 110. That is, they may include courses during which steam may be used. When the user selects one of the steam-available courses 110, the selected course may be performed. In this case, the controller 7*a* controls the washing machine to perform the course as programmed.

For example, the steam-available courses 110 may include a normal course. In the case that the user selects only the normal course, the normal course including washing, rinsing and dehydrating may be performed as programmed.

The user may select use of steam in addition to the steam-available courses 110. That is, steam may be selected as an option of the courses. This selection may be performed through the option selector 140. Specifically, the option selector 140 may include a steam option 141 allowing the selection of use of steam.

For example, when the user selects the Cotton/Normal course using the course selector 100 and then the Steam 141 option using the option selector 140, the normal course may be performed along with the steaming stage, which will be described in detail later.

The plurality of courses may also include steam-excluded courses 130. That is, the courses may include courses during which steam cannot be used. The steam-excluded courses 130 may be courses during which steam is unavailable. That is, the steam-excluded courses may be programmed such that the steaming stage is not included and/or available for selection.

In addition, the steam option 140 may be blocked from being selected together with the steam-excluded courses 130. Accordingly, when a steam-excluded course 130, e.g., a wool course is selected, the option selector 140 or the control panel 7 may be controlled so as not to allow the user to select the steam option 141.

The plurality of courses may include Steam Courses 120 including courses during which steam is automatically used. That is, a washing course may be programmed to include the steaming stage. FIG. 5 shows an allergen course 121 and a tub cleaning course 122 as examples of the steam course 120, which will be described in detail later.

Figure 6:
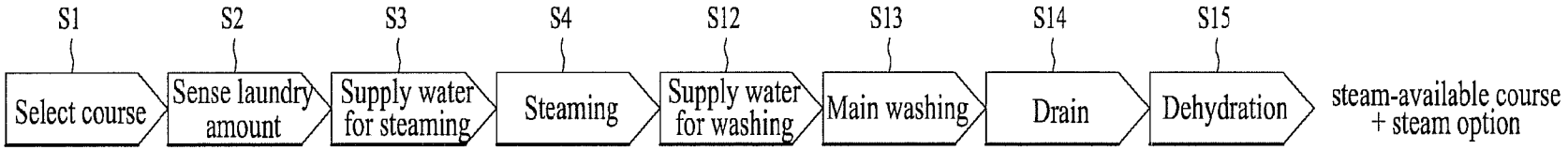
FIG. 6 is a flowchart of a control method of a washing machine, according to one embodiment as broadly described herein.
Figure 7:
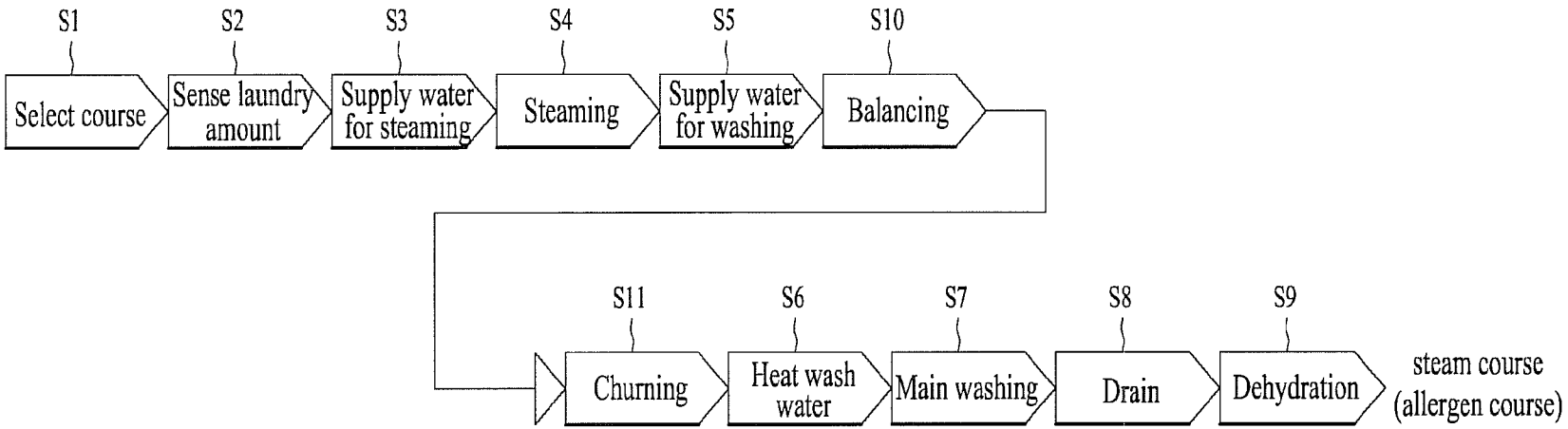
FIG. 7 is a flowchart of a control method of a washing machine, according to another embodiment as broadly described herein.

FIGS. 6 and 7 are flowcharts of a method of controlling the washing machine according to one embodiment. In particular, FIG. 6 is a flowchart of the method in the case that a steam-available course and the steam option are selected, and FIG. 7 is a flowchart of the method in the case that the steam course is selected.

The washing machine may basically start to operate with selection S1 of a particular course among a plurality of washing courses. Herein, the washing course may refer to an operation provided by the washing course. This does not necessarily refer to a course for washing of the laundry. In addition, the washing course may refer to a series of operations of the washing machine automatically performed in a pre-programmed order from the start to end of the washing course. The washing course may generally include a washing cycle, a rising cycle, and a dehydrating cycle. These cycles may be automatically performed and terminated.

In the washing machine according to this embodiment, steam may be generated by the washing heater 50 arranged at the lower portion of the outer tub 4. In addition, the wash water level for generation of steam may be set and controlled differently from the water level for water washing (washing with wash water). In addition, the steaming stage may be set to start at a time different from the start time of water washing. That is, the steaming stage and water washing may be set to be clearly distinguished from each other by time.

As described above, the courses for laundry washing other than the tub cleaning course 122 are basically performed by wash water. That is, water washing may be performed. In the case of the water washing, a sufficient amount of wash water needs to be supplied. Particularly, in the case of a vertical shaft washing machine in which washing is performed by water current, the amount of wash water is closely related to washing effect.

Accordingly, in a washing course during which water washing is performed, an amount of laundry may be sensed S2 to determine an appropriate wash water level to wash the sensed amount of laundry received in the inner tub 6, or drum 6, (laundry amount) may be performed. In other words, after performing the course selection step S1 including selecting a specific course from a plurality of washing courses, the wash water level for main washing according to the laundry amount may be determined S2. In the case of the tub cleaning course, step S2 may be omitted. This is because the wash water level for main washing may be set regardless of the laundry amount.

Herein, the main washing and the wash water level for main washing indicate the main washing cycle for a selected specific course and the wash water level for implementation of this cycle. That is, the main washing step is a stage at which water washing is performed in earnest through chemical action of the detergent, and mechanical action by driving of the inner tub 6, or drum 6, or the pulsator 9.

Accordingly, to achieve optimum washing effects in the main washing step, the optimum amount of wash water according to the amount of laundry, i.e., the wash water level for main washing, may be determined.

In a method of controlling the washing machine according to this embodiment, the steaming step may be performed before the main washing is performed. In addition, the steaming step S4 may be performed before the wash water is supplied up to the wash water level for main washing. That is, once a washing course is selected, and the wash water level for main washing is determined, the steaming step may be performed before the main washing is performed.

In certain embodiments, the sequential relationship between the steaming step S4 and the main washing is applied to both the steam course and the steam-available courses, as shown in FIGS. 6 and 7. This is because the sterilization effect and washing effect may be remarkably enhanced with low use of energy through the steaming step S4. This sequential relationship is also applicable to the tub cleaning course 122. The tub cleaning course 122 is not affected by the laundry amount, but may include main washing. In this case, the wash water level for main washing may be pre-set. Accordingly, before water is supplied up to the wash water level S12 for main washing S13, water for steaming may be supplied S3, and the steaming step S4 may be performed.

Hereinafter, a series of steps performed to generate and supply steam will be described in detail.

As discussed above, a selection may be conducted through the course selector 100 or through the course selector 100 and the option selector 140 such that the steaming step is performed in a specific washing course. That is, as shown in FIG. 6, the steaming step maybe selected through both the course selector 100 and the option selector 140. In addition, as shown in FIG. 7, the steaming step may be selected through the course selector 100.

For the specific washing course, a wash water level among a plurality of wash water levels for main washing may be determined according to the laundry amount. The wash water level for main washing may be determined regardless of the laundry amount.

To perform a specific washing course including the steaming step, wash water for generation of steam may be supplied S3. That is, in the steam course, water supply for generation of steam rather than for main washing may be performed first. In addition, when steam is used in the steam-available course, water supply for generation of steam rather than for main washing may be conducted first.

Water supply for generation of steam may be performed until the water reaches the wash water level for generation of steam S3. Herein, the wash water level for generation of steam may be a water level higher than the level of the bottom surface of the inner tub 6 and lower than the wash water level for main washing such that part of the laundry is wetted by the wash water.

As described above, in the case of the vertical shaft washing machine, the wash water level for main washing may be a water level allowing the laundry to be fully submerged in the wash water. Accordingly, the wash water level for generation of steam may be lower than any wash water level for main washing that may be determined based on the courses or the water level option. This is because increase in the amount of wash water suggests that a larger amount of energy is consumed when the water is heated to a certain temperature.

FIG. 2 shows an example of three water levels B, C and D. Water level B may be a water level at which wash water may be supplied from the outer tub 4 to the inner tub 6. That is, the water level reaching the bottom surface of the inner tub 6 may be water level B. Accordingly, at a water level higher than water level B, the laundry received in the inner tub 6 may begin to be wetted by the wash water. Water level C represents a water level that causes the blades 9*a* of the pulsator 9 to be submerged, and water level D represents a water level that causes even the cap 9*b* of the pulsator 9 to be submerged.

A plurality of blades 9*a* may be arranged extending outward in a radial direction from a central portion of the pulsator 9, and may protrude from the bottom surface of the inner tub 6 a predetermined distance upward. In addition, the cap 9*b* may be arranged at the center of the blades 9*a* and protrude further upward than the blades 9*a*. Accordingly, the wash water level for main washing may be higher than water level D to generate a wash water current and washing mechanism. This means that the laundry is not fully wetted by the wash water at a wash water level between the water level B and water level D, because a majority of the laundry is positioned over the blades 9*a* and the cap 9*b*.

Accordingly, the wash water level for generation of steam may be higher than the water level B and lower than or equal to water level D. More specifically, the wash water level for generation of steam may be between the water levels C and D. Therefore, the wash water level for generation of steam may be seen as a water level causing a portion of the laundry to be wetted in wash water. In addition, the wash water level for generation of steam may be a water level causing the upper portion of the pulsator 9 to be substantially submerged in the wash water.

Such water level of the wash water may be sensed through a frequency from the water level sensor 70. When a lower frequency is sensed, it may generally indicate a higher water level.

In addition to the wash water level for generation of steam, this embodiment may have wash water supplied toward the bottom surface of the inner tub 6 through the upper portion of the inner tub 6. That is, the wash water may be supplied to the laundry accommodated in the inner tub through the detergent box 32, along with the detergent. Water supply may be conducted until the water reaches the wash water level for generation of steam.

The laundry received in the inner tub is wetted upon supply of the wash water and detergent, and then wetted again by the supplied wash water. In some cases, a part of the laundry may not be wetted by the wash water and the detergent. However, when the steaming step S4 is performed, effective washing may be ensured by the wash water level for generation of steam and/or water supply method.

To enhance washing effect, a soaking step of submerging the laundry in the wash water and the detergent may be performed. That is, a soaking step of soaking the laundry and contaminants stuck thereto in the wash water to facilitate separation of contaminants may be performed. In addition, the soaking step may be performed to allow the detergent to be sufficiently dissolved in the wash water such that washing effect with the detergent is enhanced. Such a soaking step may be more effectively performed when hot wash water is used, because increase in temperature further enhances soaking of the laundry, contaminants and detergent. However, the soaking step performed with the laundry submerged in wash water generally takes a lot of time. In addition, heating a large amount of wash water leads to consumption of a large amount of energy.

According to this embodiment, the soaking step may be performed by consuming a small amount of energy for a short time using steam. Accordingly, effective sterilization and washing may be achieved with a low consumption of energy for a short time. Specifically, through the wash water level for generation of steam and supply of water up to the wash water level for generation of steam, a portion of the laundry is wetted by the wash water and the detergent. In addition, a portion of the laundry is also wetted by the supplied wash water and detergent.

Once the step of supplying wash water for generation of steam S3, in which the wash water is supplied up to the wash water level for generation of steam, is performed, the steaming step S4 may be performed. That is, by driving the washing heater 50, the wash water may be heated. In addition, the washing heater 50 may be driven until a first set temperature is reached. In addition, the washing heater 50 may be driven consistently and continuously. In other words, once the washing heater 50 starts to be driven, in may be consistently driven until the first set temperature is reached.

The first set temperature may be sensed by the temperature sensor 71 arranged near the washing heater 50 or on the bottom surface of the outer tub 4. That is, when the temperature sensor 71 senses the first set temperature according to heating of the wash water, the controller 7*a* stops driving of the washing heater 50.

The first set temperature may be set to be, for example, greater than or equal to 60 degrees Celsius. In certain embodiments, the first set temperature is set to be lower than the boiling point of water, or lower than the boiling point of whatever washing fluid is being used. That is, in this embodiment, the steam may be visible steam that is produced at a temperature lower than the boiling point of water, rather than invisible steam produced at a temperature greater than or equal the boiling point of water.

As described above, the wash water heated at the wash water level for generation of steam comes into contact with the laundry. The amount of heat transferred through liquid water greatly differs from the amount of heat transferred through gaseous water. This results from a great difference in contact surface area.

Accordingly, excessive increase of temperature of the wash water may cause thermal damage to the laundry, and therefore is not preferable. On the other hand, excessively low increase of temperature of the wash water may produce a very small amount of steam.

In consideration of the sterilization temperature, amount of steam, amount of consumed energy, heating time, and thermal damage to the laundry, the first set temperature may be greater than or equal to 60 degrees Celsius and lower than 70 degrees Celsius.

The first set temperature is related to the temperature of the supplied wash water. An environment in which cold water and hot water are supplied through an external water supply source may be provided. When the washing machine is used in this environment, a temperature of the wash water may be selected through a temperature option 142.

By properly adjusting the proportions of cold water and hot water to be supplied using the temperature option 142, the wash water may be supplied at the temperature selected for the wash water. The lowest temperature may represent supply of normal tap water, and the highest temperature may represent supply of hot water only.

In such an environment allowing supply of both cold water and hot water, the temperature of hot water generally does not exceed 50 degrees Celsius. The temperature may be greater than or equal to than 50 degrees Celsius. Accordingly, to minimize consumption of energy for generation of steam, wash water at the highest temperature available may be supplied to the washing machine in the step of supplying wash water for generation of steam S3. That is, depending on the installation environment of the washing machine and the conditions for control, wash water of the allowable highest temperature may be supplied. In step S3 of supplying wash water for generation of steam, operation may be controlled such that only hot water is supplied.

Herein, the first set temperature may be higher than the highest temperature of the hot water in consideration of the environment in which hot water is supplied, because heating time is needed to create an environment for generation of steam. This is intended to generate a sufficient amount of steam and allow the generated steam to create a hot and humid environment in the inner tub 6.

As shown in FIGS. 1 and 2, the outer tub 4 and the inner tub 6 are sealed and isolated from the external environment by the door 40 to some extent. Sealing is sufficient in that visible steam having large particles is prevented from leaking out of the washing machine through the door 40.

Accordingly, as the wash water is heated to the first set temperature at the wash water level for generation of steam, the visible steam creates a hot and humid environment in the inner space of the inner tub 6. That is, the detergent, laundry, and internal air are heated not only by the wash water but also by the steam.

As the temperature increases, the amount of water absorbed by the laundry increases. Thereby, the step of soaking the laundry, detergent and contaminants may be implemented in a high-temperature environment.

Steam has a larger surface area than the liquid water. Accordingly, when steam is generated, the laundry may absorb a larger amount of water. In addition, increase in temperature of the liquid suggests decrease of surface tension. Accordingly, wash water may be further smoothly absorbed by the laundry.

As such, through heating at the wash water level for generation of steam, absorption of both the liquid wash water and steam may be smoothly conducted.

In the steaming step S4, the inner tub 6 may be rotated periodically or repeatedly. That is, the pulsator 9 does not rotate independently. Rather, the inner tub 6 and the pulsator 9 integrally rotate. Accordingly, the steaming step S4 may be performed without driving the pulsator 9. Driving the pulsator 9 means that the pulsator 9 rotates with the inner tub 6 stopped.

Rotating the inner tub 6 may uniformly supply steam to the laundry. That is, this is intended to distribute the laundry as close to the bottom surface of the inner tub 6 as possible. Preferably, the inner tub 6 is rotated at a low rate of rotation, because excessive rotation of the inner tub at the wash water level for generation of steam may result in damage to the laundry.

Additionally, the low rate of rotation of the inner tub 6 may create micro vibration on the surface of the wash water. Thereby, the area of contact between air and the wash water increases. Accordingly, as the micro vibration and driving of the washing heater are simultaneously implemented, visible steam may be more effectively generated.

Hereinafter, the steam-available course will be described in detail with reference to FIG. 6.

As disclosed above, the steam-available course may be a course for which the user is allowed to select implementation of the steaming step as an option. In the steam-available course, damage to the laundry may be prevented due to the steaming step.

Once the user selects the steam-available course and the steaming step as an option (S1), sensing the laundry amount and determining the wash water level for main washing (S2), supplying wash water for generation of steam (S3), and steaming (S4) may be performed sequentially, as described above. According to a course selected thereafter, main washing may be subsequently performed. In other words, the steaming step is performed prior to main washing included in a predetermined course is performed.

That is, after steaming (S4) is completed, water supply for washing (S12) and main washing (S13) may be performed. Once the main washing step is completed, draining (S14) and simple dehydrating (S15) (or dehydration) may be performed. Thereafter, rinsing and dehydrating (or dehydration) may be sequentially performed, and then the course may be terminated.

In the case that the user selects only the steam-available course without the steam option (S1), sensing the laundry amount and determining the wash water level for main washing (S2) is performed. Supplying wash water for generation of steam (S3) and steaming (S4) are not performed. That is, when the wash water level for main washing is determined (S2), water is supplied up to the wash water level for main washing (S12). Then, main washing (S13), rinsing and dehydrating may be sequentially performed as programmed to implement the selected course.

In the steam-available course, the pattern of initial operation of the washing machine may vary greatly depending upon whether or not the steam option is selected. That is, the user may clearly recognize the difference between the operation with the steam option and the operation without the steam option since the steaming step is performed prior to the basic course. In addition, the steaming step differs clearly from the subsequent main washing in the water level and the driving of the inner tub 6 or the pulsator 9.

Selecting the steaming step as an option presumes that the user recognizes increase of consumed energy. The user may intentionally select the steaming step as an option to enhance the washing effect and the sterilization effect although the user recognizes increased energy consumption.

The steaming step may be performed at the initial stage of or prior to the steam-available course. In addition, the steaming step may be clearly distinguished from the normal steam-available course (without the steaming selected) both visually and in the time line. Accordingly, the effect of the aforementioned steaming step as well as the effect of allowing the user to intuitively and easily select the steaming step may be provided. Thereby, product satisfaction, product reliability, and convenience in using the product may be enhanced.

Hereinafter, the steam course will be described in detail with reference to FIG. 7. The steam course is a course in which steam is automatically generated. That is, regardless of whether or not the steam option is selected, steam may be generated in this course.

FIG. 5 shows the tub cleaning course 122 as an example of the steam course. Once the tub cleaning course 122 is selected, supplying wash water for generation of steam (S3) and steaming (S4) are performed as previously described. Thereby, a hot and humid steam environment is created in the interior of the inner tub 6 as well as the interior of the outer tub 4. Thereafter, water may be supplied and subsequently main washing may be performed. Still in the tub cleaning course 122, the steaming step may be performed prior to main washing.

The steam course 120 may include an allergen course 121 or allergy care course. Once the steam course is selected, determining the water level (S2), supplying wash water for generation of steam (S3), steaming (S4), and main washing are sequentially performed. That is, even if the steam option is not selected, the above steps are performed sequentially simply by selection of one of the steam courses 122.

Hereinafter, the allergen course 121 will be described in detail as an example of the steam course.

As shown in FIG. 7, once the allergen course 121 is selected, the steps up to the steaming step S4 of heating the wash water to the first set temperature may be sequentially performed. That is, the steps up to the steaming step S4 are the same as those performed when the aforementioned steam-available course and the steam option are selected together.

After the steaming step S4, the step S5 of supplying wash water up to the wash water level for main washing determined in the water level determination step S2 may be performed. Accordingly, a relatively large amount of additional wash water may be supplied.

The temperature of the wash water that has risen to the first set temperature is lowered with additional water supply, i.e., through the step of supplying water for washing. Accordingly, the wash water heating step (S6) of heating the wash water may be performed prior to the main washing (S7). In addition, to reduce energy consumption in the wash water heating step (S6), wash water of the highest temperature may be supplied in supplying water for washing (S5).

After supplying water for washing (S5) is completed, balancing (S10) and/or churning (S11) may be performed prior to heating of the wash water (S6).

Balancing (S10) may be performed to distribute the laundry evenly throughout the inner tub 6. Balancing (S10) may be performed by rotating the inner tub 6 clockwise and counterclockwise. Through balancing (S10), the laundry positioned over the wash water level for main washing may be submerged in the wash water.

In addition, after the balancing (S10) is performed, churning (S11) may be performed. Churning may be performed by driving the pulsator 9. Through churning, a water current may be created and the laundry submerged in the wash water may be moved. Through the churning step (S11), the overall laundry may be wetted by the wash water.

Herein, the allergen course 121 is a course to maximize the washing effect as well as the sterilization effect. That is, this is a course specially provided to effectively kill dust mites and other allergens.

To effectively kill dust mites, two factors of temperature and time at which the dust mites are exposed need to be met. In particular, mites should be exposed to a temperature greater than or equal to 55 degrees Celsius for more than 10 minutes to kill substantially 100% of dust mites. This condition may be referred to as an insecticidal condition. Meeting this insecticidal condition with minimum consumption of energy is a challenge. In meeting this insecticidal condition, the temperature of the laundry and wash water in addition to the temperature of the wash water and the temperature of the inner tub and outer tub in which the wash water is stored are also important.

As described above, a steam environment has been created in the steaming step (S4) and the temperature of the inner tub 6 and the outer tub 4 have sufficiently increased. Accordingly, after water for washing is supplied, the temperature of the outer tub 4 and inner tub 6 may not decrease greatly. Therefore, even when additional supply of water is conducted, it is possible to meet the insecticidal condition with a relatively small amount of energy. In addition, since wash water of the maximum temperature can be additionally supplied, decrease in temperature may be minimized.

Specifically, in the wash water heating step (S6), the wash water maybe heated to a second set temperature. That is, heating the wash water may be implemented until the temperature of the wash water reaches the second set temperature.

In certain embodiments, the second set temperature may be between 50 degrees Celsius and 60 degrees Celsius. More specifically, the second set temperature may be lower than the first set temperature. In other words, the first set temperature may be higher than the second set temperature. That is, the set temperature for heating a large amount of wash water may be low compared to the set temperature for heating a smaller amount of wash water. Thereby, the amount of energy consumed remarkably decreases in this case, compared to the opposite case. In addition, the water temperature may reach the second set temperature more easily.

Driving the inner tub 6 or the pulsator 9 in the wash water heating step (S6) may be the same as that in the steaming step (S4). That is, the wash water heating step (S6) may be performed without driving the pulsator 9.

Once the wash water heating step (S6) is completed, the main washing step (S7) is performed. That is, by driving the pulsator 9, main washing is performed. Once the main washing step (S7) is completed, draining (S8) and simple dehydrating (S9) may be performed. Thereafter, rinsing and dehydrating may be sequentially performed, 9 and then the course may be terminated.

Herein, the relationship between the first set temperature and the second set temperature for meeting the insecticidal condition with low energy consumption is important as discussed above. These temperatures may presume the wash water level for generation of steam and the wash water level for main washing.

Specifically, the first set temperature and the second set temperature may be determined prior to and after termination of heating of the wash water such that the temperature of the wash water meets the insecticidal condition.

As discussed above, the first set temperature may be higher than the second set temperature. Accordingly, the second set temperature is important to substantially meet the insecticidal condition.

As the wash water is heated, the temperature of the wash water consistently increases. However, once heating the wash water is stopped, heat is transferred to the outside and thus the temperature of the wash water decreases. Accordingly, the amount of transferred heat is proportional to the temperature difference. Therefore, when the difference in temperature between the wash water and the external environment in which the wash water is accommodated, i.e., the difference in temperature between the inner tub and the outer tub is low, the amount of transferred heat may be low. This suggests that the temperature of the wash water may decrease slowly after heating of the wash water is stopped.

The steaming step (S4) for implementation of the allergen course 121 may be a step of effectively heating the external environment. In addition, operation of the washing heater preferably includes a pause period such that heat is sufficiently transferred from the heated wash water to the laundry, the inner tub 6, and the outer tub 4. That is, in the wash water heating step (S6), the washing heater 50 may be operated with a relatively short pause period. During the pause period, heat may be sufficiently transferred to the inner tub and to the outer tub.

In certain embodiments, the churning step (S11) including driving the pulsator 9 may be performed during the pause period. The churning is intended to supply the heated wash water to the entire laundry. In addition, this step is intended to cause the laundry partially wetted by the wash water to be fully wetted.

Accordingly, the wash water heating step may include the heater driving step including continuously driving the heater 50 and the churning step including driving the pulsator 9. In certain embodiments, the heater driving step and the churning step may be performed in an alternating manner.

As discussed above, driving the pulsator 9 may be stopped in the heater driving step, while the pulsator 9 is driven and the washing heater 50 is stopped in the churning step.

The heater driving step and the churning step may be performed sequentially and repeatedly. In addition, the wash water heating step (S6) may be completed through the heater driving step.

As discussed above, the wash water heating step may be performed until the second set temperature is reached. Herein, the second set temperature may be higher than the temperature under the insecticidal condition. However, it is possible to set the second set temperature to be lower than 60 degrees Celsius. For example, the second set temperature may be set to 57 degrees Celsius.

In the case that the second set temperature is greater than or equal to 55 degrees Celsius, the temperature of the wash water will be greater than or equal to 55 degrees Celsius for a certain time in the wash water heating step (S6) until it reaches the second set temperature. Thereafter, when the heating step (S6) is terminated, the temperature of the wash water gradually decreases, falling below 55 degrees Celsius. Accordingly, a certain time may be taken for the wash water to fall below 55 degrees Celsius after the heating step is terminated. This suggests that the insecticidal condition may be met with low consumption of energy due to the difference in set temperature and water level between the steaming step S4 and the wash water heating step (S6).

Figure 8:
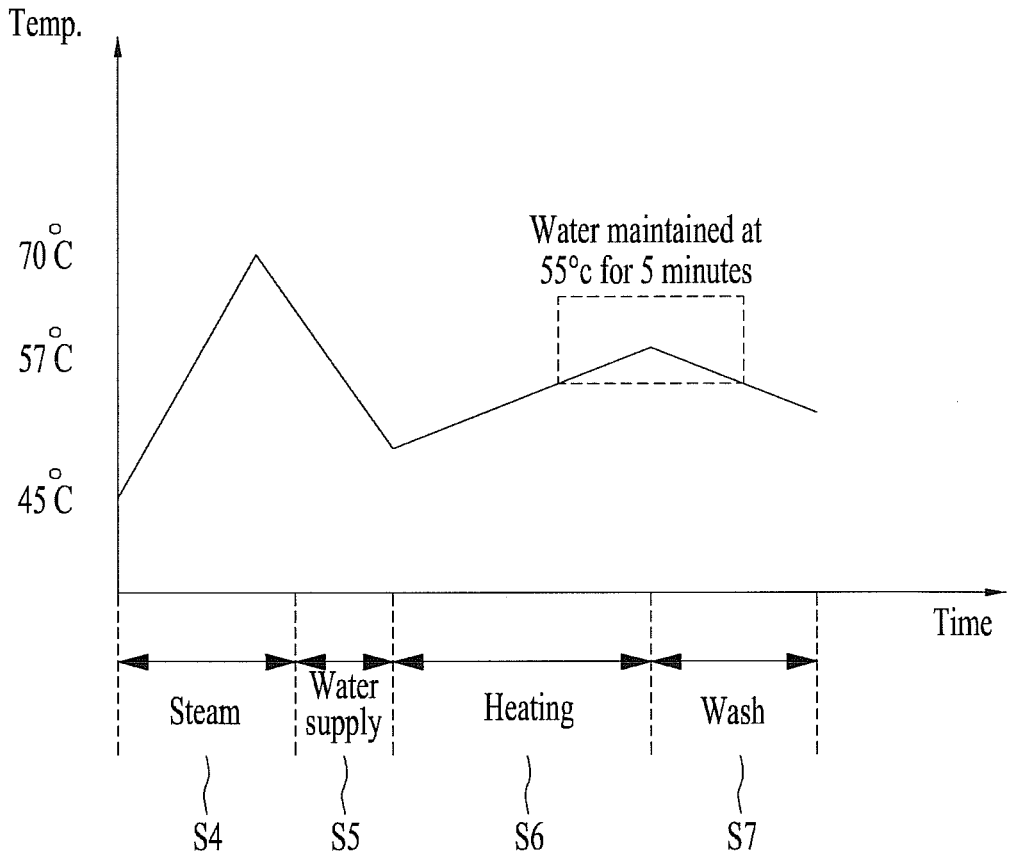
FIG. 8 is a graph of a change in wash water temperature in the allergen course.

FIG. 8 depicts change in wash water temperature in the steam course, particularly the allergen course 122.

The steaming step (S4) may be performed until the temperature of the wash water reaches the first set temperature (e.g., 70 degrees Celsius). After the steaming step S4 is terminated, hot water is additionally supplied (S5). Accordingly, the temperature of the wash water may not decrease significantly.

However, since the amount of wash water increases relatively, the wash water heating step (S6) may be performed longer than the steaming step (S4). The wash water heating step (S6) may include a plurality of pause periods.

While the wash water heating step (S6) is being performed, the temperature of the wash water gradually increases. In addition, the wash water heating step (S6) may be performed until the temperature of the wash water reaches the second set temperature (e.g., 57 degrees Celsius).

Accordingly, a section continuously meeting the insecticidal condition exists prior to and after the time at which the wash water heating step (S6) is terminated.

The section meeting the insecticidal condition may be extended by gradually increasing the second set temperature. However, in view of energy consumption, setting the second set temperature to be higher may not be preferable.

In certain circumstances, the steam course may not necessarily meet the insecticidal condition. That is, this course may include a general sterilization course rather than the allergen treatment course. In any case, the heat transfer medium may be changed. In the steaming step, a hot and humid environment may be created in the inner tub 6 substantially through steam. In the wash water heating step, a hot environment may be created in the inner tub 6 substantially through the wash water.

Due to the sequential relationship between the steaming step and the wash water heating step, and the difference in set temperature, water level and heat transfer medium, the washing effect and the sterilization effect may be enhanced, and the amount of energy consumed may be relatively reduced.

A washing machine and a method of controlling the same is provided which is capable of performing the steaming step with low energy consumption.

A washing machine and a method of controlling the same is provided which is capable of effectively enhancing the washing effect and the sterilization effect. Specifically, a washing machine and a method of controlling the same is provided which is capable of effectively soaking contaminants, laundry and a detergent at the initial stage of washing using steam.

A washing machine and a method of controlling the same is provided which may allow a user to select a washing course and a steam option intuitively and easily to ensure convenient use thereof.

A washing machine and a method of controlling the same is provided which may allow a user to clearly recognize use of steam through intuition and vision and according to time.

A washing machine and a method of controlling the same is provided which is capable of effectively killing dust mites causing allergies with low energy consumption.

A washing machine and a method of controlling the same is provided which is capable of maximizing the effect of steaming by clearly distinguishing the water level for generation of steam from the wash water level for main washing, the temperature of the wash water heater for generation of steam from the temperature of the wash water at the wash water level for main washing, and the steaming step from the main washing step.

A method of controlling a washing machine to perform a washing course by heating wash water, as embodied and broadly described herein, may include a course section step of selecting a certain washing course among a plurality of washing courses, a water level determination step of sensing on an amount of laundry accommodated in an inner tub (a laundry amount) and determining a wash water level for main washing, a wash water for generation of steam supplying step of supplying wash water up to a wash water level for generation of the steam such that a portion of the laundry is wetted by the wash water, the wash water level for generation of the steam being higher than a bottom surface of the inner tub and lower than the wash water level for main washing, a steaming step of heating the wash water to a first set temperature and generating steam from the wash water by driving a washing heater provided to an outer tub accommodating the inner tub, a water for washing supplying step of supplying the wash water up to the wash water level for main washing, and a main washing step of performing the main washing.

The wash water may be supplied toward the bottom surface of the inner tub through an upper portion of the inner tub. That is, in the wash water for generation of steam supplying step and the water for washing supplying step, water may be supplied directly toward the laundry accommodated in the inner tub.

The wash water may be supplied to the inner tub through a detergent box. Accordingly, wash water and the detergent may be supplied to the laundry through the wash water for generation of steam supplying step before the steaming step is performed.

The above steps may be performed sequentially. That is, the steaming step may be performed prior to the main washing step.

The washing courses may include a course (a steam-available course) allowing selecting whether to perform the wash water for generation of steam supplying step and the steaming step. In addition, the wash water for generation of steam supplying step and the steaming step may be performed through selecting of the steam-available course and a steam option. That is, when only the steam-available course is selected, a predetermined course may be performed without implementation of the steaming step. When the steam-available course and the steam option are selected, predetermined course may be performed after the steaming step is performed.

The washing courses may include a course (a steam-excluded course) excluding selection of the wash water for generation of steam supplying step, the steaming step, and the steam option. In any case, the steam-excluded course may be a predetermined course during which the steaming step is not performed. Accordingly, during the course, selection of the steam option may not be allowed.

The washing courses may include a course (a steam course) of sequentially performing the above steps. That is, the washing courses may include a course during which the steaming step is automatically performed simply by selecting the course. During the steam course, the main washing may be performed after the steaming step is performed.

Accordingly, in a washing machine as embodied and broadly described herein, the steaming step may be performed though selection of a course or through the course and the steam option. In any case, however, the steaming step may be performed prior to the main washing.

Since the steaming step precedes the main washing step, the user may clearly recognize whether or not the steaming step is performed according to time. In addition, the steaming step and the main washing step may be clearly distinguished from each other. Thereby, the use may also recognize whether or not the steaming step is performed.

The steaming step may differ greatly from the main washing step in the water level and the driving pattern of the inner tub and the pulsator. Therefore, the user may easily and intuitively recognize whether or not the steaming step is performed.

The first set temperature may be equal to or higher than 60 degrees Celsius. The first set temperature may be lower than 70 degrees Celsius. Herein, the first set temperature may be higher than the highest possible temperature of the provided wash water. In a washing machine installation environment allowing supply of hot water, the temperature of the hot water may not exceed 50 degrees Celsius. Therefore, to generate a sufficient amount of steam, the first set temperature may be set to be higher than the highest temperature of the wash water.

A pulsator may be provided to the bottom surface of the inner tub, wherein the wash water level for generation of steam is a water level causing an upper portion of the pulsator to be substantially submerged.

At this water level for generation of steam, the laundry positioned at the lowest portion of the inner tub may be submerged in the wash water. However, most of the laundry may be positioned above the water level of the wash water for generation of steam. The generation of steam at the level of wash water for generation of steam allows the laundry to be quickly wetted, and promote soaking of the laundry, the contaminants, and the detergent.

In the wash water for generation of steam supplying step, the wash water may be supplied to the inner tub at a highest possible temperature. Similarly, in the water for washing supplying step, the wash water of the highest possible temperature may be supplied.

The steaming step may be performed without driving the pulsator. Since the water level is very low, driving the pulsator may damage the laundry. Although the pulsator is not driven, rotation of the inner tub is not excluded. That is, in the steaming step, the inner tub may rotate for a certain time. In structure, rotation of the inner tub may imply integral rotation of the inner tub and the pulsator. Accordingly, when the pulsator is not driven, it may suggest that only the pulsator does not rotate.

The method may further include a wash water heating step of re-driving the washing heater and heating the wash water to a second set temperature after termination of the water for washing supplying step.

The second set temperature may be lower than the first set temperature.

The main washing step may be performed after termination of the water for washing supplying step. The first set temperature and the second set temperature may be determined such that the wash water is maintained at a temperature equal to or higher than 55 degrees Celsius for a time equal to or longer than 10 minutes prior to and after termination of the wash water heating step.

The second set temperature may be equal to or higher than 50 degrees Celsius and equal to or lower than 60 degrees Celsius.

The wash water heating step may be performed without driving the pulsator.

The wash water heating step may include a heater driving step of continuously driving the heater and a churning step of driving the pulsator. Driving of the pulsator may be stopped in the heater driving step, and driving of the heater may be stopped in the churning step.

The heater driving step and the churning step may be performed sequentially and repeatedly.

In another aspect as embodied and broadly described herein, a washing machine may include an outer tub to store wash water, an inner tub arranged in the outer tub to accommodate laundry, a course selection part allowing selection of a plurality of washing courses, an option selection part allowing selection of a specific option for the washing courses, a washing heater provided to the outer tub to heat the wash water, a water supply means to supply the wash water directly to the inner tub, and a controller to determine the wash water level for main washing based on an amount of the laundry accommodated in the inner tub (a laundry amount) and a certain washing course selected through the course selection part and control the water supply means to supply water up to the wash water level for main washing to perform the main washing, wherein, when the course selection part is selected or a steaming step is selected through the course selection part and the option selection part, the controller controls the water supply means such that water is supplied up to a level of wash water for generation of steam lower than a level of wash water for the main washing prior to the main washing, and controls driving of the washing heater to heat the wash water to a first set temperature to generate steam, thereby performing the steaming step.

The course selection part may include a steam course allowing the steaming step to be automatically performed by selection of a course, a steam-available course allowing section of the steaming step in addition to selection of the course, and a steam-excluded course excluding the steaming step.

The steam course may include an allergen course to remove materials causing allergies, wherein, when the allergen course is selected, the controller controls driving of the washing heater after supply of water to the level of wash water for the main washing such that the wash water is heated to a second set temperature lower than the first set temperature.

The option selection part may include a steam selection part allowing selecting implementation of the steaming step only when the steam-available course is selected through the course selection part, wherein, when the steam-available course and the steaming step are selected, the controller performs control operation such that the steam-available course is sequentially performed after the steaming step is conducted.

In another aspect as embodied and broadly described herein, a method of controlling a washing machine to perform a washing course by heating wash water may include a step of receiving selection of a course to perform a steaming step through selection of the course or the selection of the course and selection of a steam option, a wash water for generation of steam supplying step of supplying the wash water and a detergent toward a bottom surface of an inner tub up to a wash water level for generation of the steam such that a portion of laundry is wetted by the wash water, the wash water level being higher than the bottom surface of the inner tub and lower than a wash water level for main washing, a steaming step of heating the wash water to a first set temperature and generating steam from the wash water by driving a washing heater provided to an outer tub accommodating the inner tub, a water for washing supplying step of supplying the wash water up to a predetermined wash water level for main washing according to the selected course or a wash water level for main washing differently set according to the selected course and an amount of the laundry accommodated in the inner tub, and a main washing step of performing the main washing by driving a pulsator at a wash water level for the main washing.

Herein, the wash water level for the main washing may be set to remain higher than the wash water level for generation of steam regardless of the selected course and the amount of the laundry accommodated in the inner tub.

In addition, the steaming step may be performed prior to the main washing step regardless of the selected course. That is, the main washing may be performed by additionally supplying water after the steaming step is performed.

The features of the embodiments described above may be implemented in combination with each other unless they are mutually contradictory or exclusive.

In another aspect as embodied and broadly described herein, a method of controlling a washing machine to perform a washing course by heating wash water may include a wash water for generation of steam supplying step of supplying wash water up to a wash water level for generation of the steam such that a portion of laundry accommodated in an inner tub is wetted by the wash water, the wash water level being higher than a bottom surface of the inner tub and lower than a wash water level for main washing, a steaming step of heating the wash water to a first set temperature and generating steam from the wash water by driving a washing heater provided to an outer tub accommodating the inner tub, a water for washing supplying step of supplying the wash water up to the wash water level for main washing, and a wash water heating step of re-driving the washing heater and heating the wash water to a second set temperature, the second set temperature being lower than the first set temperature.

In another aspect as embodied and broadly described herein, a method of controlling a washing machine to perform a washing course by heating wash water may include a wash water for generation of steam supplying step of supplying wash water up to a wash water level for generation of the steam such that a portion of laundry accommodated in an inner tub is wetted by the wash water, the wash water level being higher than a bottom surface of the inner tub and lower than a wash water level for main washing, a steaming step of heating the wash water to a first set temperature and generating steam from the wash water by driving a washing heater provided to an outer tub accommodating the inner tub, a water for washing supplying step of supplying the wash water up to the wash water level for main washing, a wash water heating step of re-driving the washing heater and heating the wash water to a second set temperature, the second set temperature being lower than the first set temperature, and a main washing step, wherein the first set temperature and the second set temperature are determined such that the wash water is maintained at a temperature equal to or higher than 55 degrees Celsius for a time equal to or longer than 10 minutes prior to and after termination of the wash water heating step.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a vertical shaft washing machine comprising an inner tub having an open upper portion, the method comprising:

receiving a washing course selection from a plurality of washing courses;

sensing an amount of laundry received in an inner tub of the washing machine and determining a wash water level for main washing;

supplying water up to a steam water level for generation of steam based on the selected washing course through the upper portion of the inner tub toward a bottom surface of the inner tub such that laundry accommodated in the inner tub becomes wet, wherein the steam water level for generation of the steam is above a bottom surface of the inner tub and lower than the wash water level for main washing;

heating the water supplied to the steam water level to a first set temperature and generating steam from the heated water and supplying the generated steam to the inner tub based on the selected washing course, wherein heating the water to the first set temperature comprises driving a heater provided at an outer tub in which the inner tub is received;

supplying water up to the wash water level for main washing after the heating the water supplied to the steam water level; and performing a main washing process for the main washing, wherein heating the water supplied to the steam water level to the first set temperature and generating steam and supplying the steam to the inner tub is performed with the inner tub periodically or repeatedly rotating without driving a pulsator provided at a bottom surface of the inner tub.

2. The method according to claim 1, wherein supplying water to the wash water level comprises supplying water to the inner tub through a detergent box.

3. The method according to claim 1, wherein receiving a washing course selection, determining a wash water level for main washing, supplying water up to a steam water level for generation of steam, heating the water to a first set temperature and generating steam, supplying water up to a wash water level for main washing, and performing a main washing process are performed sequentially.

4. The method according to claim 3, wherein the plurality of washing courses includes at least one steam-available course, wherein the at least one steam-available course provides for selection of whether or not to supply water up to the steam water level for generation of steam and to heat the water supplied to the steam water level to the first set temperature.

5. The method according to claim 4, wherein supplying water to the steam water level and heating the water supplied to the steam water level to the first set temperature are performed in response to selection of one of the at least one steam-available course and a steam option.

6. The method according to claim 5, wherein the plurality of washing courses includes at least one steam-excluded course in which supplying water to the steam water level, heating the water supplied to the steam water level to the first set temperature, and the steam option are not performed.

7. The method according to claim 3, wherein the plurality of washing courses includes a steam course, comprising sequentially performing selecting a washing course, determining a wash water level for main washing, supplying water up to a steam water level for generation of steam, heating the water supplied to the steam water level to a first set temperature and generating steam, supplying water up to a wash water level for main washing, and performing a main washing process.

8. The method according to claim 1, wherein the first set temperature is greater than or equal to 60 degrees Celsius.

9. The method according to claim 8, wherein the first set temperature is lower than 70 degrees Celsius.

10. The method according to claim 1, wherein the steam water level is a water level at which an upper portion of the pulsator is submerged.

11. The method according to claim 1, further comprising, after supplying water up to the wash water level, driving the heater again and heating the water supplied up to the wash water level to a second set temperature.

12. The method according to claim 11, wherein the second set temperature is lower than the first set temperature.

13. The method according to claim 12, wherein heating the water to the first set temperature and heating the water to the second set temperature maintaining the water at a temperature that is greater than or equal to 55 degrees Celsius for a time period that is greater than or equal to 10 minutes prior to and after termination of heating the water to the second set temperature.

14. The method according to claim 12, wherein the second set temperature is greater than or equal to 50 degrees Celsius and less than or equal to 60 degrees Celsius.

15. The method according to claim 11, wherein heating the water to the second set temperature comprises continuously driving the heater and performing a churning step comprising driving the pulsator.

16. The method according to claim 15, wherein driving of the pulsator is stopped while the heater is continuously driven, and driving of the heater is stopped while performing the churning step.

17. The method according to claim 16, wherein continuously driving the heater and performing the churning step are performed sequentially and repeatedly.

* * * * *